US007757615B2

(12) United States Patent
McDonald, II et al.

(10) Patent No.: US 7,757,615 B2
(45) Date of Patent: Jul. 20, 2010

(54) SHELF ASSEMBLY

(75) Inventors: Ernest M. McDonald, II, Osceola, IN (US); Eugene A. Dylewski, II, Granger, IN (US); John E. Knudtson, Granger, IN (US)

(73) Assignee: Utilimaster Corporation, Wakarusa, IN (US)

( * ) Notice: Subject to any disclaimer, the term of this patent is extended or adjusted under 35 U.S.C. 154(b) by 0 days.

(21) Appl. No.: 11/086,041

(22) Filed: Mar. 22, 2005

(65) Prior Publication Data

US 2005/0211140 A1 Sep. 29, 2005

Related U.S. Application Data

(60) Provisional application No. 60/555,601, filed on Mar. 23, 2004.

(51) Int. Cl.
*A47B 9/00* (2006.01)

(52) U.S. Cl. ..... 108/108; 108/147.17

(58) Field of Classification Search ..... 108/106, 108/107, 108, 147.11, 147.17, 147.18; 211/90.01, 211/149, 150, 187; 248/240
See application file for complete search history.

(56) References Cited

U.S. PATENT DOCUMENTS 1,228,042 A * 5/1917 Dowd ..... 126/190
1,473,850 A 11/1923 Greene
2,574,483 A 11/1951 Jack
2,809,849 A * 10/1957 Benne ..... 182/88
3,874,009 A 4/1975 Nosaka et al.
3,897,971 A 8/1975 Evans
3,911,832 A 10/1975 Vandergriff
3,929,371 A 12/1975 Gibson
3,934,924 A 1/1976 Diliberti
4,159,122 A * 6/1979 Stevens ..... 280/166
4,281,870 A 8/1981 Ehrlich
4,730,738 A 3/1988 Bartus et al.
5,143,337 A 9/1992 Tomayko, Jr. et al.
5,314,200 A 5/1994 Phillips
5,452,972 A * 9/1995 Adams ..... 410/89
5,720,535 A * 2/1998 Mehman ..... 312/219
5,755,478 A 5/1998 Kamiya et al.
5,848,660 A * 12/1998 McGreen ..... 180/206
5,868,263 A 2/1999 McAllister et al.
5,934,725 A 8/1999 Bowers
6,192,806 B1 2/2001 Chen
6,196,141 B1 * 3/2001 Herron et al. ..... 108/108
6,347,590 B1 2/2002 D'Annunzio et al.
6,487,979 B2 12/2002 Ash et al.
6,962,116 B2 * 11/2005 Bienick et al. ..... 108/108

* cited by examiner

*Primary Examiner*—José V Chen
*Assistant Examiner*—Matthew W Ing
(74) *Attorney, Agent, or Firm*—Barnes & Thornburg LLP

(57) ABSTRACT

A vehicle that includes a shelf assembly is provided. The shelf assembly includes a shelf panel, pivot mount, and an over-center extension/retraction assembly. The shelf panel is coupled to the vehicle and is movable between stowed and use positions. The pivot mount is coupled to the shelf panel and to a wall located on the vehicle. The shelf panel pivots with respect to the pivot mount between the stowed and use positions. The over-center extension/retraction assembly is coupled to the pivot mount and is engagable with the shelf panel to assist moving the shelf to at least the stowed position.

6 Claims, 8 Drawing Sheets

SHELF ASSEMBLY

RELATED APPLICATIONS

The present application is related to and claims priority to U.S. Provisional Patent Application Ser. No. 60/555,601, filed on Mar. 23, 2004, entitled SHELF ASSEMBLY. The subject matter disclosed in that provisional application is hereby expressly incorporated into the present application.

TECHNICAL FIELD

The present invention relates generally to vehicle accessories and more particularly to a shelf assembly for use on a vehicle.

BACKGROUND AND SUMMARY

Shelving systems for vehicles, particularly those for delivery vehicles, are known. Typical shelving systems include stationary or rigid shelves. More recently, foldable shelves that are movable between stowed and use positions, as well as being removable, add flexibility to the utility of the delivery vehicle.

It may be useful, however, to provide a shelving system that provides additional convenience to the operator, particularly in a delivery vehicle environment where the shelves are movable. Assisting the operator in moving or adjusting the shelves can provide greater ease of use within the delivery vehicle. This may be important where such convenience saves the operator time and effort.

Accordingly, one embodiment of the present disclosure provides a vehicle that includes a shelf assembly which comprises a shelf panel, pivot mount, and an over-center extension/retraction assembly. The shelf panel is coupled to the vehicle and is movable between stowed and use positions. The pivot mount is coupled to the shelf panel and to a wall located on the vehicle. The shelf panel pivots with respect to the pivot mount between stowed and use positions. The over-center extension/retraction assembly is coupled to the pivot mount and is engagable with the shelf panel to assist moving the shelf panel to at least the stowed position.

The above and other illustrative embodiments may also comprise: the over-center extension/retraction assembly assists moving the shelf panel to the use position; the over-center extension/retraction assembly being a gas piston; the pivot mount further comprising a pivot that is coupled to the shelf panel that pivots the shelf panel between stowed and use positions; the over-center extension/retraction assembly being pivotably attached to the pivot mount; the over-center extension/retraction assembly being pivotably attached to the pivot mount at a location spaced apart from the pivot; the shelf mount being made of a plastic material at a location that contacts the shelf panel; the shelf panel being made of a metallic material that is contactable with the plastic material of the shelf mount; a gusset that is coupled to the shelf panel, wherein at least a portion of the over-center extension/retraction assembly being located within the gusset; the over-center extension/retraction assembly being coupled to the gusset; and one end of the over-center extension/retraction assembly being coupled to the gusset and the other end being coupled to the shelf mount.

Another illustrative embodiment of the present disclosure provides a vehicle having a shelf assembly that attaches to a wall of the vehicle which comprises at least one longitudinally extending brace, a shelf panel, and an over-center extension/retraction assembly. The at least one longitudinally extending brace is attached to the wall of the vehicle. The shelf panel is movable between stowed and use positions and is oriented substantially non-parallel to the longitudinally extending brace. The over-center extension/retraction assembly is engagable with the shelf panel to assist moving the shelf to at least the stowed position.

The above and other illustrative embodiments may also comprise: the over-center extension/retraction assembly assists moving the shelf panel to the use position; the over-center extension/retraction assembly being a gas piston; the shelf panel having an opening disposed therethrough configured to receive at least a portion of the brace; a pivot mount attached to the brace and coupled to the shelf panel, such that the shelf panel is movable about the pivot mount between stowed and use positions; a gusset coupled to the shelf panel, wherein at least a portion of the over-center extension/retraction assembly being located within the gusset; the over-center extension/retraction assembly being coupled to the gusset; and, one end of the over-center extension/retraction assembly being coupled to the gusset and the other end being coupled to the shelf mount.

Another illustrative embodiment of the present disclosure provides a vehicle comprising a vertically oriented wall panel and a shelf assembly. The shelf assembly comprises a shelf panel movable between use and stowed positions, and an assist means coupled to the shelf panel that assists moving the shelf panel to at least the stowed position.

Additional features and advantages of the shelf assembly will become apparent to those skilled in the art upon consideration of the following detailed description of the illustrated embodiment exemplifying the best mode of carrying out the shelf assembly as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the shelf assembly, and such exemplification is not to be construed as limiting the scope of the shelf assembly in any manner.

DETAILED DESCRIPTION OF THE DRAWINGS

Figure 1:
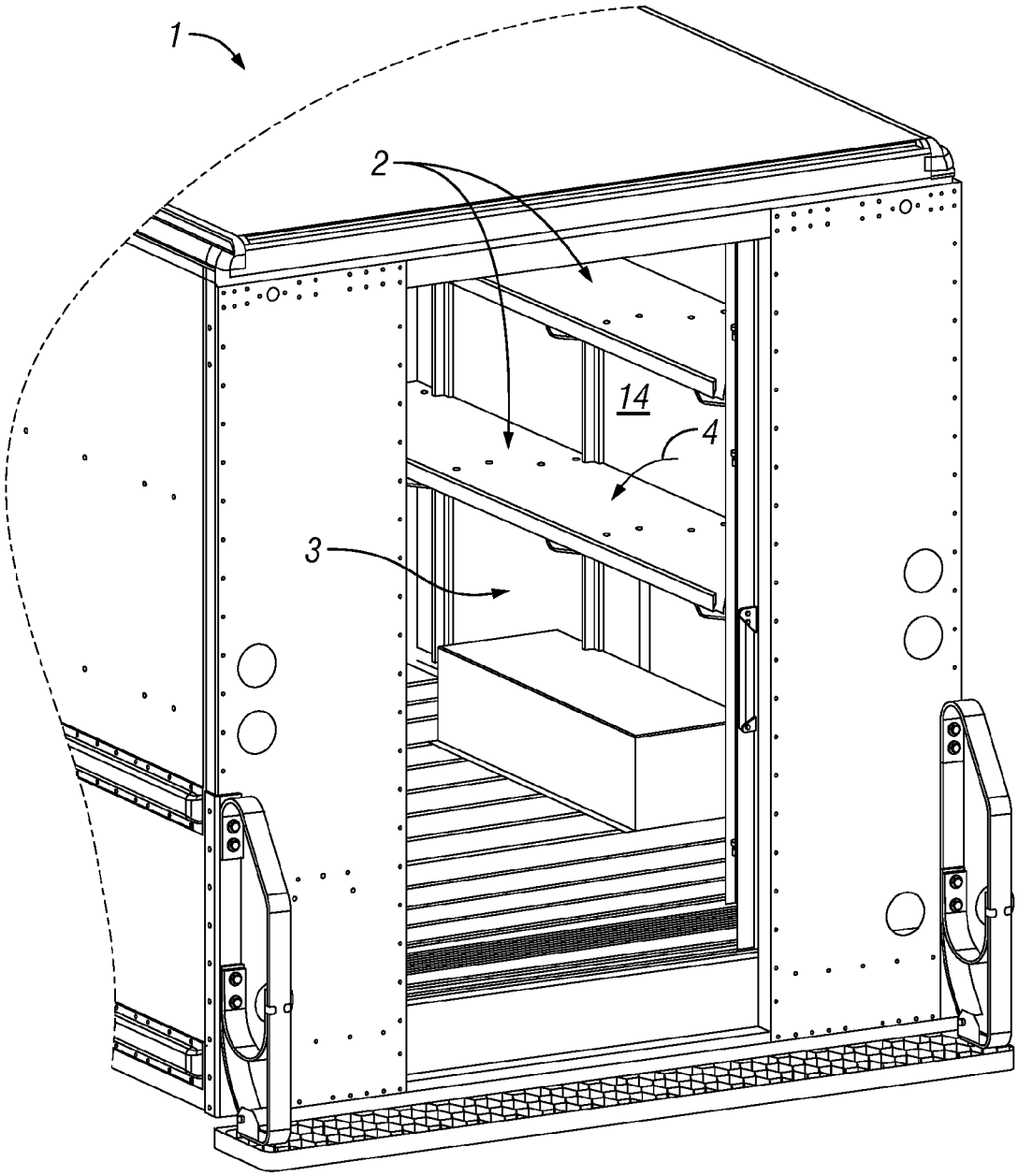
FIG. 1 is a rearward perspective view of an illustrative vehicle with an illustrative embodiment of the shelf assembly attached thereto.

A rearward perspective view of an illustrative vehicle 1 with an illustrative embodiment of shelf assembly 2 attached thereto is shown in FIG. 1. The shelf assembly 2 is shown attached to wall 14 and extending into the interior of vehicle 1. Illustrative t-studs 12 are attached to vehicle side wall 14. The illustrative vehicle 1 shown, is a cargo or delivery vehicle configured to carry objects such as parcels, equipment, or supplies. It is appreciated, however, that in other illustrative embodiments, a shelf assembly could be attached to other types of vehicles including automobiles, tractor/trailers, aircraft, and watercraft. Specifically, a plurality of shelf assemblies 2 are shown in the use position 4 and are configured to support objects while in this position. The shelf assembly 2 is further configured to be movable to a stowed position (see e.g., FIGS. 7 and 8) where it is less intrusive in storage compartment 3 of the vehicle. It is appreciated, however, that the shown use position is for illustrative purposes and it is contemplated that in other embodiments the shelf assembly can be alternatively positioned to define its use position.

It is appreciated that there can be any number of t-studs, shelf mounts, and gussets used with this assembly based, for example, upon the support weight or length requirements of the shelf. Long shelves or shelves that need to support heavy loads may require more than the two t-studs shown in FIGS. 2 and 3.

Figure 2:
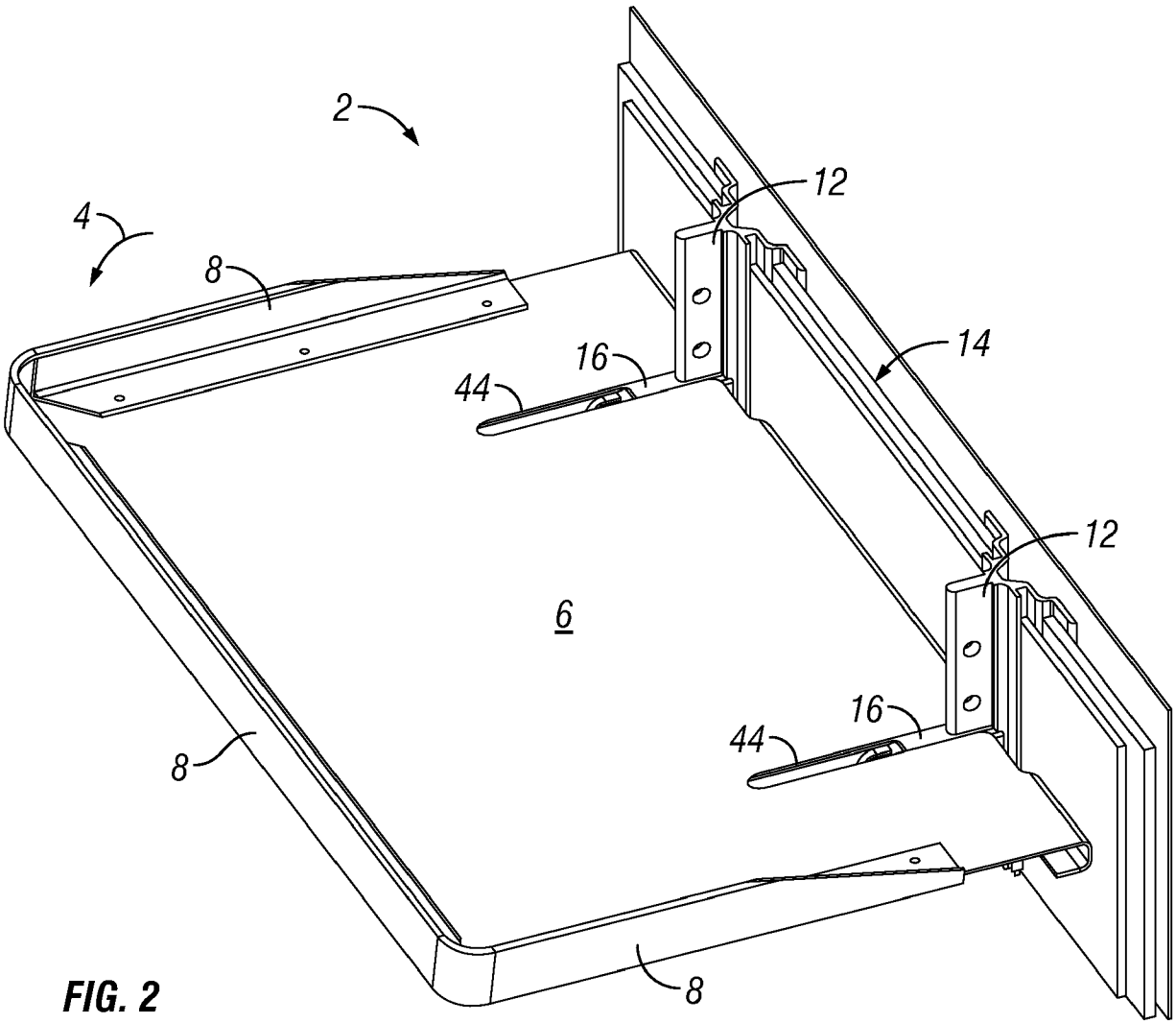
FIG. 2 is a downward-looking perspective view of an illustrative embodiment of the shelf assembly attached to a wall.

A downward-looking perspective view of shelf assembly 2 located in the use position 4 is shown in FIG. 2. This illustrative embodiment of shelf assembly 2 comprises a shelf panel 6 bounded by shelf edging 8. The shelf assembly is shown extending from wall 14. Illustrative gussets 10 (see FIG. 3) are attached to the underside of shelf panel 6 and assist in structural support of the same. Shelf edging 8 is illustratively attached to surface of shelf panel 6 as shown. Shelf panel 6 further comprises slots 44 extending inwardly from the outer periphery of shelf panel 6, adjacent the t-studs 12. In the illustrative embodiment, slots 44 are configured to receive at least a portion of the fastening portion 20 of t-stud 12. (See e.g., FIGS. 7 and 8.) It is appreciated that in alternative embodiments the t-stud can be configured in any manner or in alternate profiles to carry the shelf panel 6 as desired. These alternate embodiments may exclude the "t" cross-sectional profile.

Figure 3:
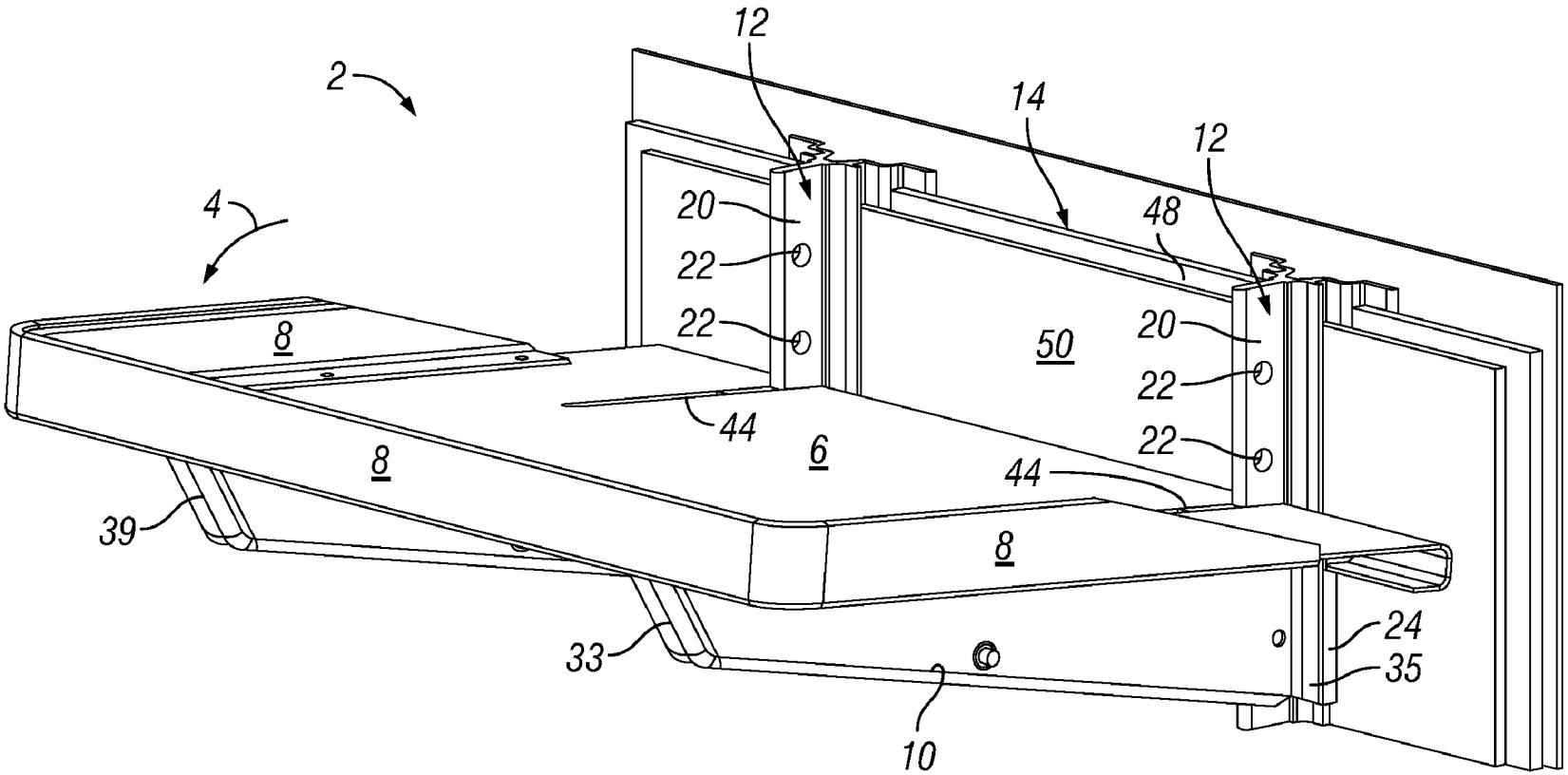
FIG. 3 is a side perspective view of the shelf assembly of FIG. 2.

A side perspective view of shelf assembly 2, again located in its illustrative use position 4, is shown in FIG. 3. In this view, gussets 10 are shown extending from wall 14 and attached to shelf panel 6. In the illustrative embodiment, flange 35 of gussets 10 engages shelf mount 16 at abutment 24 to allow increased strength of shelf assembly 2. As articles are placed on shelf panel 6, a moment force is applied to abutment 24 and ultimately wall 14. The gussets, therefore, serve to strengthen the shelf panel by applying a horizontal force against the vehicle wall.

Figure 4:
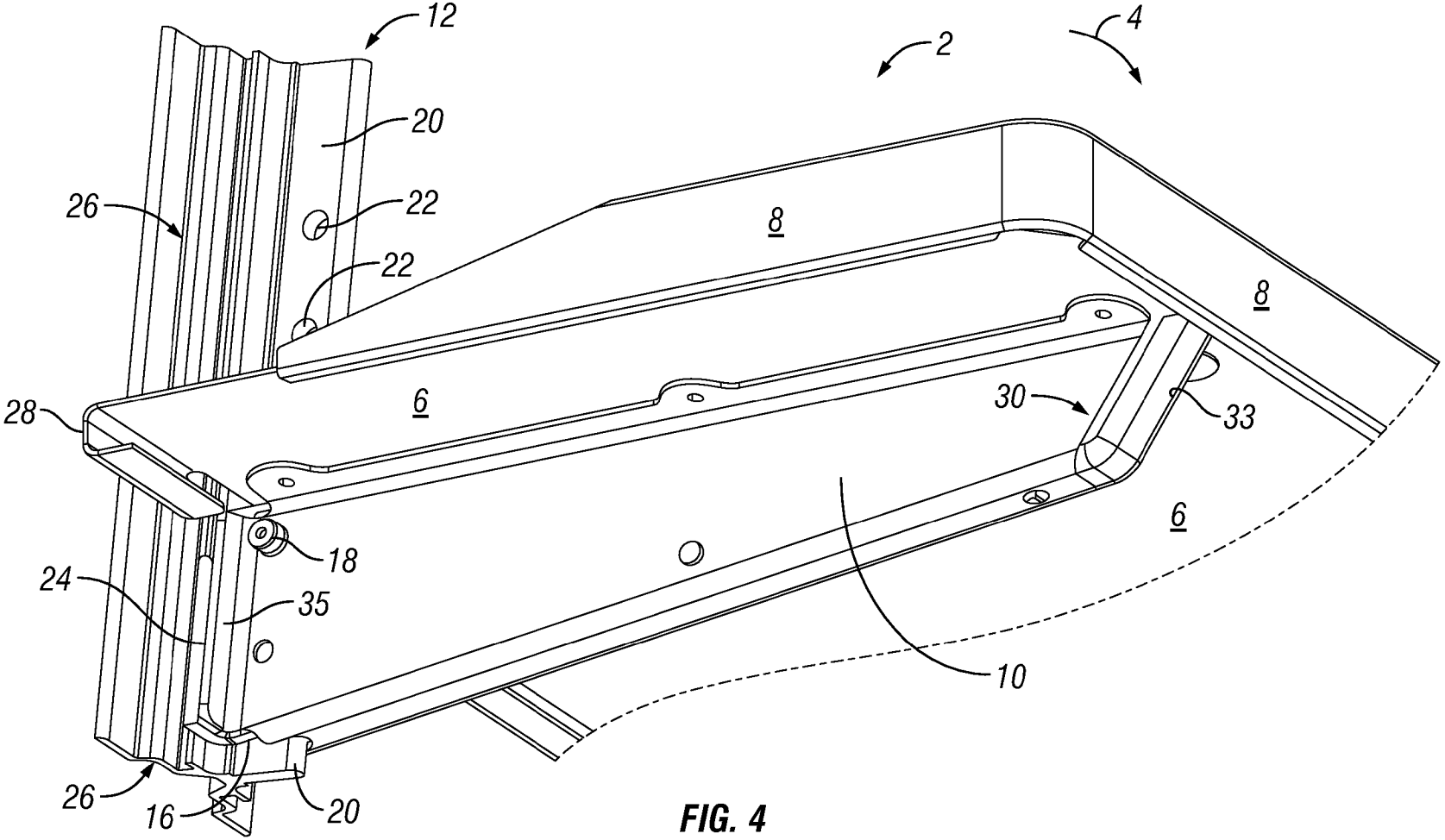
FIG. 4 is an upward-looking perspective view of a portion of an illustrative embodiment of the shelf assembly.

An upward-looking underside perspective view of a portion of shelf assembly 2 is shown in FIG. 4. This view shows how shelf panel 6 is pivotably coupled with respect to t-stud 12. In this illustrative embodiment, shelf assembly 2 comprises a shelf mount 16 which itself is illustratively coupled to gusset 10. (See also FIG. 5.) Shelf mount 16 illustratively engages t-stud 12. In this illustrative embodiment, a shelf pivot 18 extends through shelf panel 6, shelf mount 16, and gusset 10, as well as fastening portion 20 of t-stud 12. (See also FIG. 8.) The fastening portion 20 comprises a plurality of vertical adjustment holes 22 which are disposed therethrough to receive shelf pivot 18. This allows shelf assembly 2 to be located at any desired height along t-stud 12 by removing and replacing the shelf pivot 18 in the desired vertical adjustment pivot hole 22. Illustratively, shelf pivot 18 comprises a dowel or fastener that extends through pivot hole 22 and is fastened adjacent mount 16 and shelf panel 6. In this illustrative embodiment, abutment 24 is attached to shelf mount 16 and engages base portion 26 of t-stud 12 or wall 14 for limiting the pivot movement of shelf 2, thereby locating the same in its illustrative use position 4. Also shown in this illustrative embodiment is the terminal portion 30 of gusset 10, illustratively angled as shown to provide greater strength to shelf panel 6. A cap 33 is disposed on the terminal portion 30 of the gusset 10.

To assist an operator in moving the shelf between use and stowed positions, an over-center mechanism is used. The over-center mechanism assists moving the shelf to a desired position. In some illustrative embodiments, the over-center mechanism also assists in maintaining the shelf in either the use or stowed positions. As an example, when attempting to move a shelf, applying a force to that shelf causes the over-center mechanism to exert a force as well. When a threshold of force is exerted on the shelf by the operator, the over-center mechanism will have a tendency to continue applying a force on that shelf, either in combination or independent of the force exerted by the operator. This translates into less force being required by the operator to move the shelf to the desired position. In addition, illustrative embodiments of the over-center mechanism may continue to apply a holding force after the shelf has reached the desired position in order to maintain the shelf thereto. In alternative embodiments, examples of such over-center mechanisms may include a gas or fluid cylinder assembly, an electrically powered assembly, a coil spring, a leaf spring, and/or a cam/roller mechanism.

Figure 5:
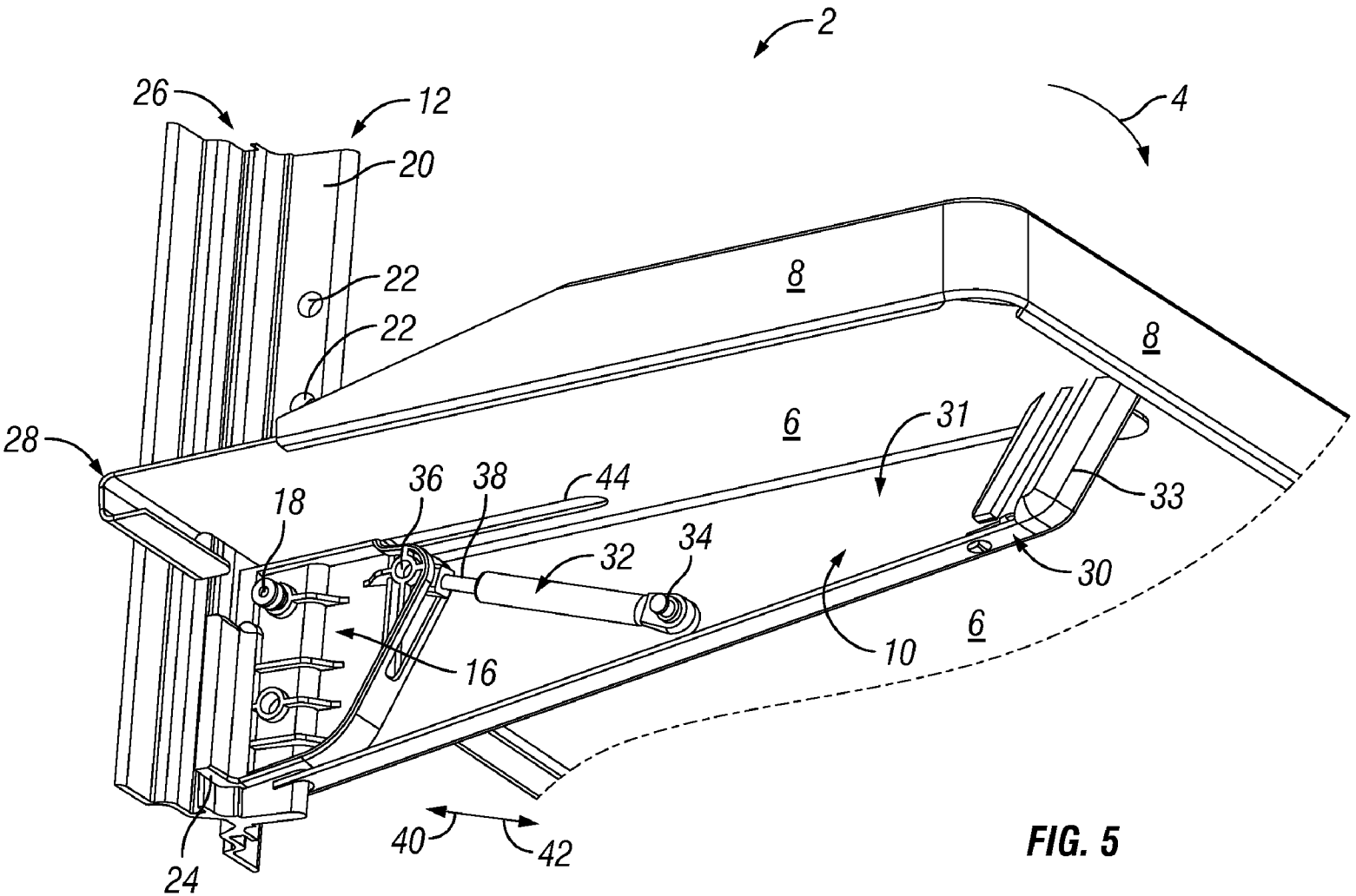
FIG. 5 is another upward-looking perspective view of the shelf assembly of FIG. 4 with a portion of the gusset cut away.

In this illustrative embodiment, such over-center mechanism depicted, is a gas spring 32 pivotably attached at one end 34 to gusset 10, and the other end 36 to shelf mount 16. The gas spring 32 is located within gusset 10. Illustratively, the gas spring 32 assists moving the shelf in the use position and may assist maintaining the shelf in its use position. When moving to a use position, illustratively, the piston rod 38 of gas spring 32 retracts by moving in direction 42. Conversely, shelf panel 6 moves to a stowed position (see e.g., FIGS. 7 and 8) when piston rod 38 extends, moving in direction 40. Also shown is the body of shelf mount 16. As depicted in FIG. 5, at least a portion of that body is located within gusset 10, extending to shelf panel 6 and outwardly from gusset 10. The shelf mount 16 is located within the channel portion 31 of gusset 10. The channel portion 31 is merely an empty space configured to receive at least a portion of shelf mount 16 and, illustratively, the over-center mechanism. Furthermore, in one illustrative embodiment, shelf mount 16 may be made from a plastic material to prevent metal-on-metal contact between shelf assembly 2 and t-stud 12.

Figure 6:
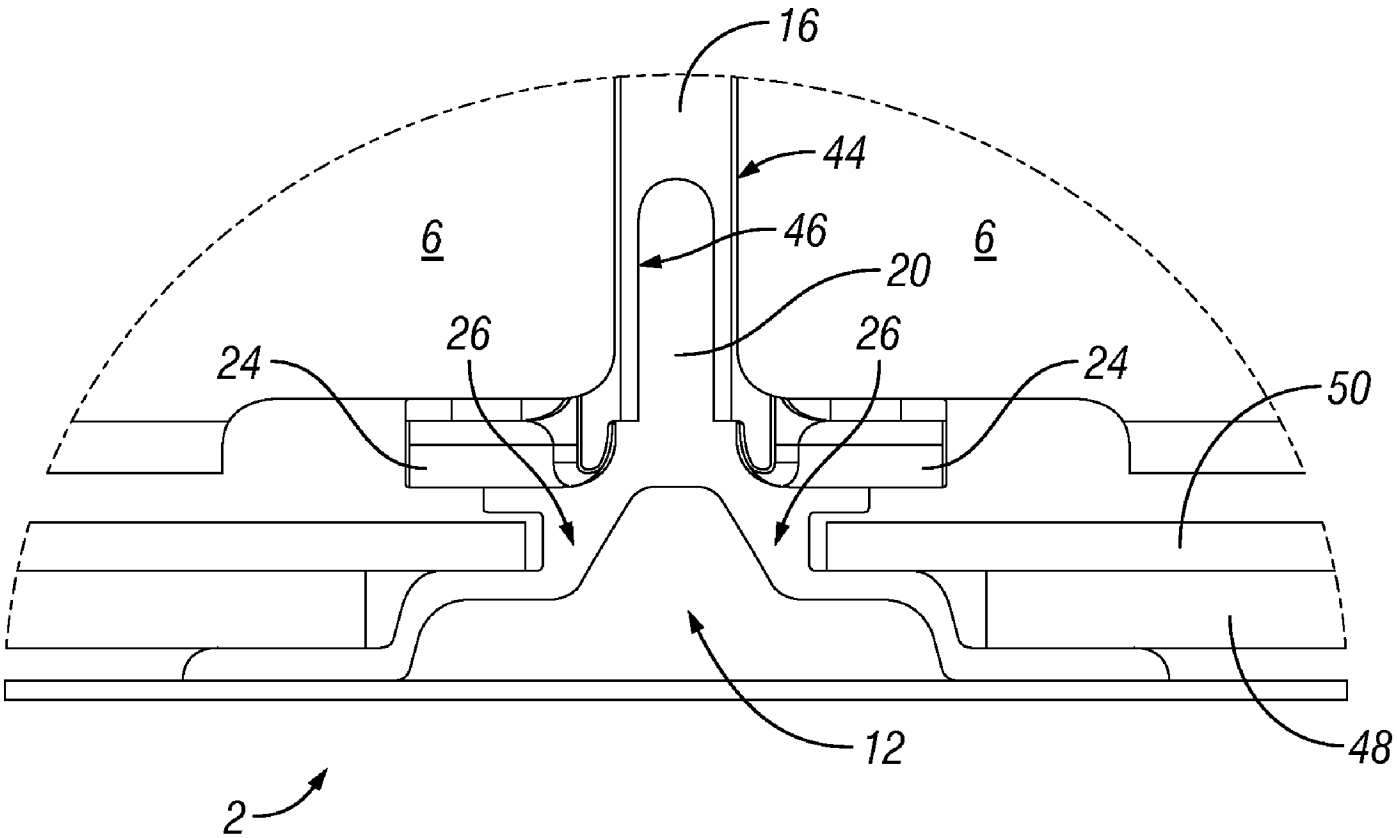
FIG. 6 is a top detail view of a portion of the shelf assembly of FIG. 3.

A top detailed view of a portion of shelf assembly 2 is shown in FIG. 6. This view shows the relationship between t-stud 12 and shelf mount 16 when assembly 2 is located in use position 4. As shown herein, the fastening portion 20 of t-stud 12 is disposed through a slot 46, and through mount 16. As previously discussed, mount 16 can be made of a polyurethane or other light material to prevent metal-on-metal contact between shelf panel 6 and t-stud 12. Also shown in this embodiment are the abutment portions 24 that engage the base portion 26 of t-stud 12. In this illustrative embodiment, t-stud 12 can be attached to wall 14. It is appreciated that wall 14 may comprise a plurality of layers including insulation layer 48 and/or liner layer 50.

Figure 7:
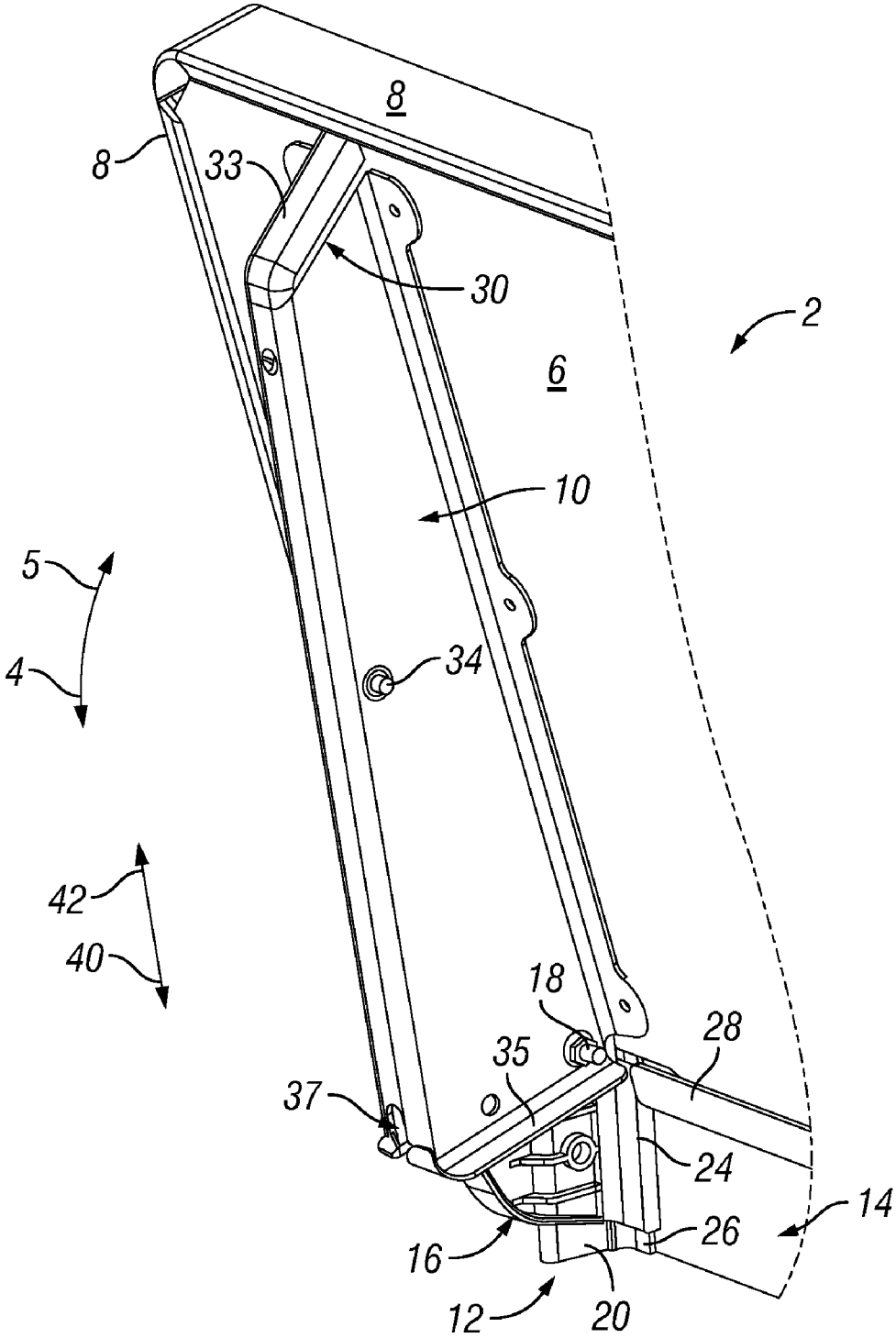
FIG. 7 is a perspective view of a portion of an illustrative embodiment of the shelf assembly with the shelf panel moved to a stowed position.
Figure 8:
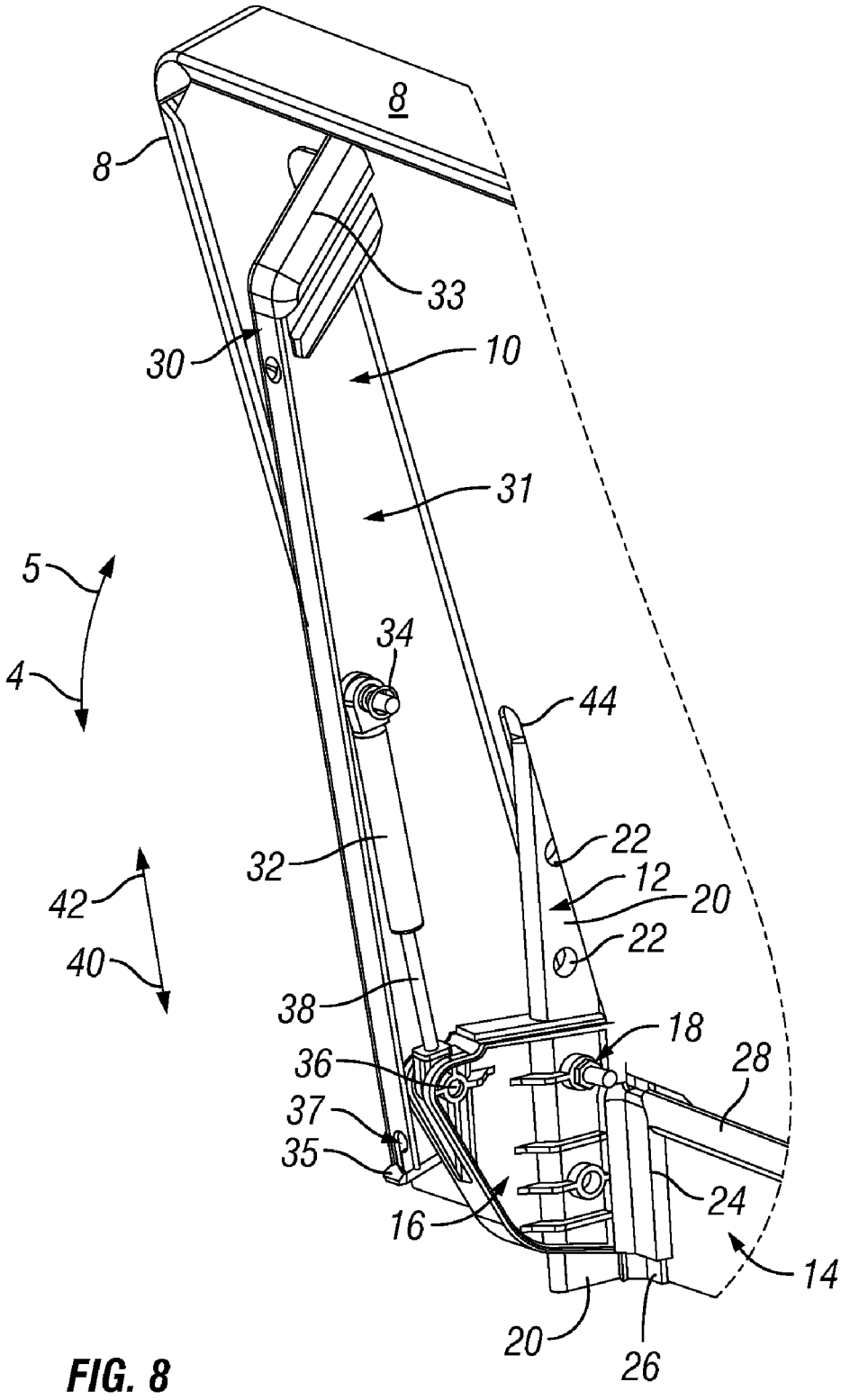
FIG. 8 is another perspective view of the portion of the shelf assembly of FIG. 7 with a portion of the gusset cut away.

A perspective view of a portion of shelf assembly 2 located in its illustrative upward stowed position 5 is shown in FIGS. 7 and 8. With respect to FIG. 7, pivot 18 pivots shelf panel 6 and gusset 10 upwardly. The shelf mount 16 illustratively remains stationary as the shelf panel 6 moves. In this embodiment, because gusset 10 comprises a channel portion 31, a portion of shelf mount 16 can be located within the gusset while the shelf assembly 2 is located in its use position and at least a portion of shelf mount 16 can be located exterior of the gusset while shelf assembly 2 is in its stowed position. Also shown in this illustrative embodiment is the abutment 24 formed with shelf mount 16 such that a flange 35, extending from gusset 10, engages abutment 24 when in the use position 4. Gusset 10 is also shown with an illustrative slot 37 that accommodates the particular configuration of the t-stud 12, similar to slot 46 of shelf mount 16. As the shelf is moved to its stowed position, the piston rod 38 of gas spring 32 extends. This extension assists the shelf in moving upwardly, and may prevent it from pivoting downward unintentionally. The gas spring 32 may also be configured to maintain shelf panel 6 in its use position. The slot 44 in shelf panel 6 also accommodates t-stud 12 while in the stowed position 5. It is appreciated that the shelf pivots at shelf pivot 18, and is illustratively spaced apart from gas spring end 36. Also shown in this view is cap 33 attached to the terminal portion 30 of gusset 10. It is appreciated from this view that moving the shelf to the upright stowed position 5 decreases the shelf's profile in the vehicle compartment.

Although the present disclosure has been described with reference to particular means, materials, and embodiments, from the foregoing description one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A vehicle including a shelf assembly comprising:

a shelf panel coupled to the vehicle and movable between stowed and use positions;

a gusset attached to an underside of the shelf panel to support the shelf panel; said gusset having first and second ends, said first end being proximate a pivot, and said second end being distal from said pivot a t-stud vertically-oriented wall bracket attached to a wall located on the vehicle;

a shelf mount removably attached to the t-stud;

said pivot being coupled to the shelf mount, wherein the shelf panel pivots with respect to the shelf mount about the pivot between the stowed and use positions and the pivot removably attaches the shelf mount to the t-stud;

an over-center extension and retraction cylinder with a first end pivotally coupled to the gusset and a second end pivotally coupled to the shelf mount wherein the first and second ends are axially opposed;

wherein the over-center extension and retraction cylinder assists moving the shelf panel to stowed and use positions;

wherein as the over-center extension and retraction cylinder extends, it pushes the shelf panel against the weight of gravity pivoting the shelf panel toward the stowed position so that when in the stowed position the shelf panel is located between the over-center extension and retraction cylinder and the wall of the vehicle;

wherein the first end of the over-center extension and retraction cylinder is coupled to the gusset at a location distal from the shelf panel and the first end of the gusset;

wherein the second end of the over-center extension and retraction cylinder is coupled to the shelf mount at a location that is spaced apart from the pivot while proximal to both the shelf panel and the first end of the gusset;

wherein the shelf mount includes an abutment that engages the gusset when the shelf panel is pivoted to the use position and separated from the gusset when the shelf panel is pivoted to the stowed position; and wherein the shelf panel includes a slot that receives a portion of the t-stud when the shelf panel is in the stowed position.

2. The vehicle of claim 1, wherein the over-center extension and retraction cylinder includes a gas piston.

3. The vehicle of claim 1, wherein the shelf mount is made of a plastic material at a location that contacts the shelf panel.

4. The vehicle of claim 3, wherein the shelf panel is made of a metallic material that is contactable with the plastic material of the shelf mount.

5. The vehicle of claim 1, wherein at least a portion of the over-center extension and retraction cylinder is located within the gusset.

6. The vehicle of claim 5, wherein the gusset includes a channel formed between first and second walls, and wherein the channel selectively receives at least a portion of the shelf mount.

* * * * *